US011826869B2

(12) United States Patent
Elek et al.

(10) Patent No.: US 11,826,869 B2
(45) Date of Patent: Nov. 28, 2023

(54) KNIFE AND TOOL SHARPENER

(71) Applicant: EdgeCraft Corporation, Avondale, PA (US)

(72) Inventors: Bela Elek, Wilmington, DE (US); Bill Hessler, Lincoln University, PA (US); George Jensen, Newark, DE (US)

(73) Assignee: EDGECRAFT CORPORATION, Avondale, PA (US)

( * ) Notice: Subject to any disclaimer, the term of this patent is extended or adjusted under 35 U.S.C. 154(b) by 1331 days.

(21) Appl. No.: 16/251,948

(22) Filed: Jan. 18, 2019

(65) Prior Publication Data

US 2019/0224801 A1 Jul. 25, 2019

Related U.S. Application Data

(60) Provisional application No. 62/619,349, filed on Jan. 19, 2018.

(51) Int. Cl.

| | |
|---|---|
| ***B24B 3/54*** | (2006.01) |
| ***B24B 23/08*** | (2006.01) |
| ***B24B 47/12*** | (2006.01) |
| ***B26D 7/12*** | (2006.01) |
| ***B25F 3/00*** | (2006.01) |
| ***B24B 3/52*** | (2006.01) |
| ***B25F 5/02*** | (2006.01) |
| ***B24B 23/02*** | (2006.01) |

(52) U.S. Cl.

CPC ..... *B24B 3/54* (2013.01); *B24B 3/52* (2013.01); *B24B 23/02* (2013.01); *B24B 23/08* (2013.01); *B24B 47/12* (2013.01); *B25F 3/00* (2013.01); *B26D 7/12* (2013.01); *B25F 5/02* (2013.01)

(58) Field of Classification Search

CPC .. B24B 3/54; B24B 3/52; B24B 3/265; B24B 3/36; B24B 45/00; B24B 45/003; B24B 47/12; B26D 7/12; B23B 23/02; B23B 23/08; B23B 41/00; B23B 41/04; B25F 3/00; B25F 5/02

USPC ..... 451/293, 177, 267, 263, 261, 282, 349, 451/45, 193, 192, 194, 371

See application file for complete search history.

(56) References Cited

U.S. PATENT DOCUMENTS

| | | | | |
|---|---|---|---|---|
| 2,482,633 A * | 9/1949 | Nichols | ..... | B24B 3/54 451/194 |
| 2,798,345 A | 7/1957 | Spear et al. | | |
| 3,071,899 A * | 1/1963 | Hicks | ..... | B24B 3/54 464/44 |

(Continued)

FOREIGN PATENT DOCUMENTS

| | | | |
|---|---|---|---|
| CN | 201769083 U | * | 3/2011 |
| EP | 0493785 B1 | | 3/1997 |

OTHER PUBLICATIONS

Du (CN-201769083-U), EspaceNet English Translation, see citations in Pertinent Prior art. (Year: 2011).*

*Primary Examiner* — Joel D Crandall
*Assistant Examiner* — Makena S Markman
(74) *Attorney, Agent, or Firm* — Michael E. Dockins; Shumaker, Loop & Kendrick LLP

(57) ABSTRACT

A sharpening tool having a handle having a variable speed switch and a support grip, a removable universal tool adapter rotatably coupled to the handle, a locking feature for locking a position of the removable universal tool adapter, and a motor for driving a tool coupled to the removable universal tool adapter.

19 Claims, 9 Drawing Sheets

(56) References Cited

U.S. PATENT DOCUMENTS

| | | | | |
|---|---|---|---|---|
| 4,677,792 | A | 7/1987 | Speidel | |
| 5,251,407 | A | 10/1993 | Afshar | |
| 5,611,726 | A * | 3/1997 | Friel | B24B 3/54 451/177 |
| 6,113,476 | A | 9/2000 | Friel, Sr. et al. | |
| 6,752,702 | B1 * | 6/2004 | Thompson | B24D 7/12 451/344 |
| 6,802,763 | B1 | 10/2004 | Leung | |
| 8,678,882 | B1 * | 3/2014 | Huber | B24D 15/065 76/82.2 |
| 9,050,709 | B1 * | 6/2015 | Dovel | B24D 15/065 |
| 9,656,372 | B2 * | 5/2017 | Weiner | B24B 3/54 |
| 2011/0201257 | A1 | 8/2011 | Walker | |
| 2011/0244766 | A1 | 10/2011 | Smith et al. | |
| 2015/0147945 | A1 | 5/2015 | Smith et al. | |

* cited by examiner

KNIFE AND TOOL SHARPENER

CROSS-REFERENCE TO RELATED APPLICATIONS

This application claims the benefit of U.S. Provisional Application No. 62/619,349, filed on Jan. 19, 2018. The entire disclosure of the above application is incorporated herein by reference.

FIELD

The present technology relates to a sharpening tool that combines multiple sharpening functions in a hand held electric power driven assembly.

INTRODUCTION

This section provides background information related to the present disclosure which is not necessarily prior art.

Various types of specialized sharpeners exist to address the needs dictated by different types of cutting instruments or other tools that should be maintained in a sharp condition. There are times when it would be desirable to have a multifunctional tool that can accommodate various rotating tool accessories, including various sharpening functionalities, into a single compact unit. Examples include where a do-it-yourself (DIY) homeowner desires to sharpen a lawnmower blade, polish a car, grind a weld, drive a drill bit, rotate a screwdriver bit, among other operations that utilize rotational motion. Another type of sharpening functionality includes a scissors sharpener that can be used for scissors or shears used for cutting lines such as line snippers. A further sharpening functionality includes maintaining a cutting edge of hedge loppers in a sharp condition.

It would be advantageous if various types of sharpening functionalities could be provided as a compact common sharpener assembly so that individual and particular sharpening functionalities are conveniently and readily available. Providing multiple sharpening functionalities could also be useful in situations where sharpening functionalities are assembled or used in combination and where sharpening functionalities can accommodate a wide range of work surfaces; e.g., multiple types of tool edges. Such features would allow the same sharpening functionality or a series of multiple sharpening functionalities to operate on a various tools, such as a pair of scissors or shears as well as a lawnmower blade, for example.

Accordingly, there exists a need in the art for a sharpening tool that combines multiple sharpening functions in a handheld electric power driven assembly, with quickly removable self-aligning accessories that can be combined in a multi-use package to sharpen various tools, including kitchen utensils, scissors, shears, outdoor tools and sporting goods utensils and tools, various knives, various other tools like axes, machetes, and chisels, lawn and garden tools including lawnmower blades and hedge loppers, amongst other cutting implements.

SUMMARY

The present technology includes articles of manufacture, systems, and processes that relate to a handheld sharpening tool configured to drive one or more interchangeable sharpening accessories. The sharpening tool is reversibly coupled to an interchangeable sharpening accessory that is configured to provide one or more sharpening functionalities so that different types of cutting and shearing tools can be readily sharpened, polished, or ground for material removal and displacement. The assembly provides optimized utility for a DIY homeowner, worker, or repair shop.

A sharpening tool is provided that includes a housing, a first handle, an electric motor, an electric power input, a switch, an accessory attachment point, and a sharpening accessory. The first handle is disposed on the housing and can be integrally formed as part of the housing. The electric motor is disposed within the housing, where the electric motor configured to rotate a driveshaft. The switch is disposed on the housing, where the switch is selectable to operate the electric motor using the electric power input. The accessory attachment point is on the housing. The sharpening accessory is configured to be reversibly coupled to the accessory attachment point, where the sharpening accessory is coupled the driveshaft to translate rotation of the driveshaft to rotation of a first disk having a first sharpening surface thereon when the sharpening accessory is coupled to the accessory attachment point. The sharpening accessory can take various forms and various interchangeable sharpening accessories can be reversibly coupled to the accessory attachment point.

One type of sharpening accessory is a first sharpening accessory that includes a first accessory housing, a first translation shaft, a first aperture and a first resilient member. The first translation shaft is disposed within the first accessory housing, where the first disk is coupled to the first translation shaft and the first translation shaft is coupled to the driveshaft to translate rotation of the driveshaft to rotation of the first disk when the first sharpening accessory is coupled to the accessory attachment point. The first aperture is formed in the first accessory housing, where a portion of the first sharpening surface of the first disk disposed within the first aperture. The first resilient member is disposed on the first accessory housing proximate the first aperture, where the first resilient member is configured to bias a tool edge against the first sharpening surface of the first disk when the tool edge is disposed within the first aperture.

Another type of sharpening accessory is a second sharpening accessory that includes a second accessory housing, a second disk, a second translation shaft, a first angled notch, and a second angled notch. The second disk has a second sharpening surface thereon. The second translation shaft is disposed within the second accessory housing, where the first disk and the second disk are coupled to the second translation shaft. The second translation shaft is coupled to the driveshaft to translate rotation of the driveshaft to rotation of the first disk and the second disk when the second sharpening accessory is coupled to the accessory attachment point. The first angled notch is formed in the second accessory housing, where a portion of the first sharpening surface of the first disk is disposed within the first angled notch and the first angled notch provides a first bevel angle for a first side of a tool edge disposed therein. The second angled notch is formed in the second accessory housing, where a portion of the second sharpening surface of the second disk is disposed within the second angled notch and the second angled notch provides a second bevel angle for a second side of a tool edge disposed therein.

Yet another type of sharpening accessory is a third sharpening accessory that includes a third accessory housing, a chuck, and a third translation shaft. The first disk reversibly coupled to the chuck. The third translation shaft is disposed within the third accessory housing, where the third translation shaft couples the driveshaft to the chuck to translate rotation of the driveshaft to rotation of the first disk when the third sharpening accessory is coupled to the accessory attachment point.

A sharpening tool kit is provided that includes a sharpening tool as described herein along with a first sharpening accessory as described herein, a second sharpening accessory as described herein, and/or a third sharpening accessory as described herein, where each sharpening accessory is configured to be reversibly coupled to the accessory attachment point.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1 is a perspective view of an embodiment of a sharpening tool without a sharpening accessory coupled to an accessory attachment point.

FIG. 2 is a perspective view of the embodiment of the sharpening tool without a sharpening accessory coupled to an accessory attachment point, as per FIG. 1, showing where a user can grasp a handle formed in a housing of the sharpening tool and actuate a trigger, where an electric power input can be inserted into the sharpening tool, and how the accessory attachment point can be operated to reversibly couple the sharpening accessory.

DETAILED DESCRIPTION

Figure 1:
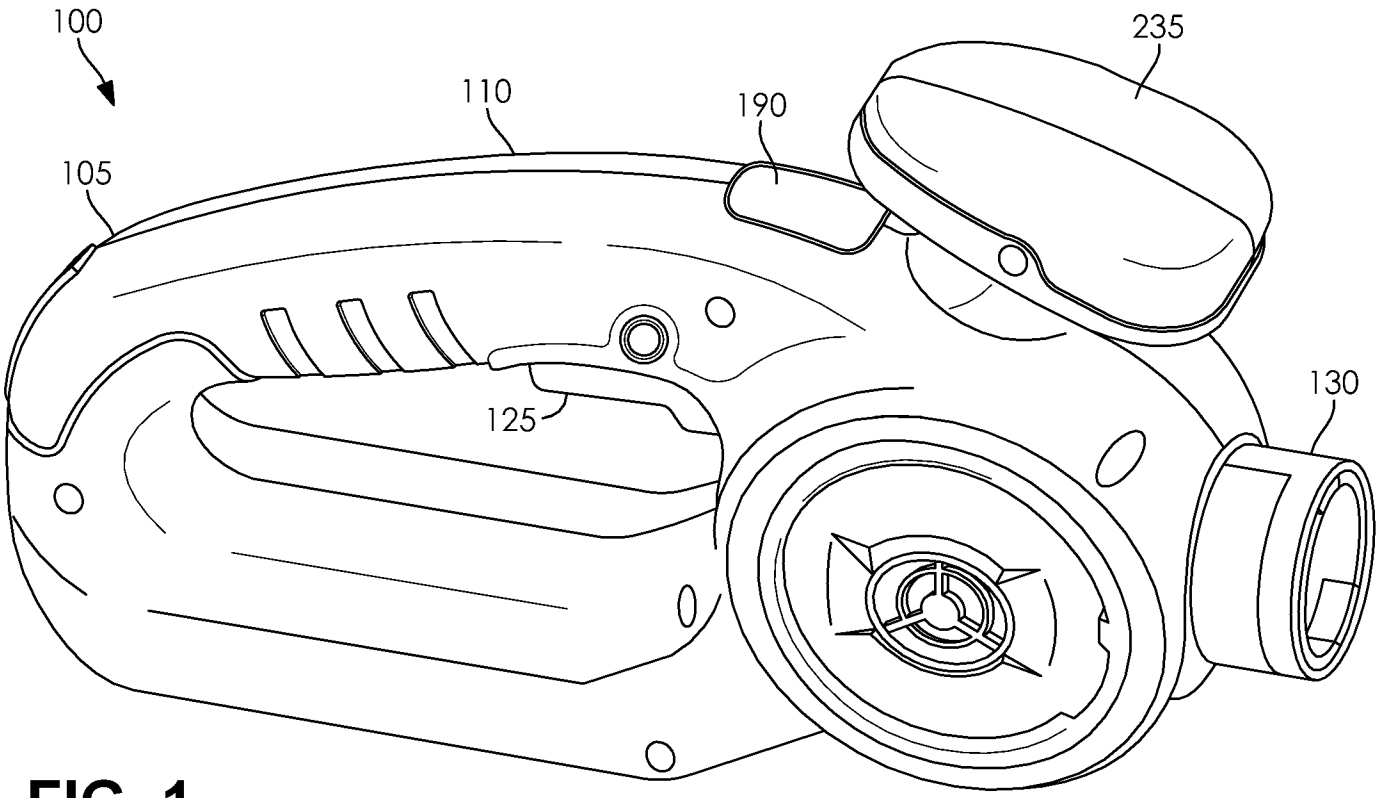

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The present technology relates to a sharpening tool that can be configured with multiple sharpening accessories, each sharpening accessory providing one or more sharpening functionalities. The sharpening tool can take the form of a handheld electric power driven tool with tooless removable self-aligning sharpening accessories that can be combined in a multi-use package or kit for sharpening kitchen, hunting, fishing, and utility knives, scissors, shears, and other edged tools or implements such as axes, machetes, lawnmower blades, chisels and other small cutting implements.

The sharpening tool includes an accessory attachment point for use with various sharpening accessories. Common aspects of such sharpening accessories include the ability to be reversibly coupled to the accessory attachment point of the sharpening tool. When the sharpening accessory is coupled to the accessory attachment point, the sharpening accessory is configured to be coupled a driveshaft of the tool in order to translate a rotation of the driveshaft to rotation of a first disk having a first sharpening surface thereon. Various configurations of sharpening accessories can provide multiple sharpening functionalities in a single accessory and multiple accessories can be customized for particular sharpening applications, including various sized tools, the ability to work various tool materials and surface shapes, the ability to impart multiple sharpening stages and/or multiple bevel angles to a tool edge or surface. The adaptable configuration of the sharpening tool can therefore provide multiple sharpening functionalities in one compact unit. For example, the sharpening tool can use a single sharpening accessory to sharpen a knife as well as a lawnmower blade, or specialized interchangeable sharpening accessories can be swapped out, where one sharpening accessory is optimized for kitchen knives of a certain type of steel and another sharpening accessory is optimized for larger tool edges such as lawn mower blades of a softer type of steel.

Sharpening tools as provided herein include a housing, a first handle disposed on the housing, and an electric motor disposed within the housing, where the electric motor is configured to rotate a driveshaft. An electric power input is included and a switch is disposed on the housing, where the switch is selectable to operate the electric motor using the electric power input. An accessory attachment point is provided on the housing and a sharpening accessory is configured to be reversibly coupled to the accessory attachment point. When the sharpening accessory is coupled to the accessory attachment point, the sharpening accessory is coupled to the driveshaft to translate rotation of the driveshaft to rotation of a first disk having a first sharpening surface thereon. In this way, the first disk and associated first sharpening surface can be rotated and placed in contact with a tool edge for sharpening the tool edge. The sharpening surface can include one or more media having various coarseness, abrasiveness, or grit values to grind or abrade material from the tool edge at a particular angle in order to sharpen the tool edge.

Various sharpening tools can include the following aspects. The first handle can be formed as an integral portion of the housing. The sharpening tool can include a second handle projecting from a single point of the housing. In this way, the sharpening tool can be used with one or two hands depending on the nature of the sharpening operation, the tool or tool edge geometry, and/or the configuration of the sharpening accessory. The switch can be a variable speed switch that is configured to operate the electric motor at a plurality of speeds and rotate the driveshaft at a plurality of speeds. In this way, various speeds can be translated from the rotation of the driveshaft to rotation of the first disk. The variable speeds can be multiple discrete speed settings or can be continuously variable from no rotation to a maximum rotation speed. A safety switch can also be included on the housing, where actuation of the safety switch is necessary to actuate the switch to operate the electric motor using the electric power input. The electric power input can include an electric cord configured to electrically couple the sharpening tool to an electric power system, such as through an electric outlet. Alternatively, the electric power input can include a rechargeable battery, where the rechargeable battery can be reversibly coupled to or at least partially within the housing of the sharpening tool, or where the rechargeable battery is enclosed within the housing and can be recharged by connecting a charging cable to a charge point on the sharpening tool housing.

In certain embodiments, the sharpening accessory is configured as a first sharpening accessory that includes a first accessory housing and a translation shaft disposed within the first accessory housing. The first disk is coupled to the translation shaft, where the translation shaft is coupled to the driveshaft to translate rotation of the driveshaft to rotation of the first disk when the first sharpening accessory is coupled to the accessory attachment point. A first aperture is formed in the first accessory housing, where a portion of the first sharpening surface of the first disk is disposed within the first aperture. A first resilient member is disposed on the first accessory housing proximate the first aperture, where the first resilient member is configured to bias a tool edge against the first sharpening surface of the first disk when the tool edge is disposed within the first aperture.

The first sharpening accessory can include the following aspects. The first sharpening accessory can include a second disk, a second aperture, and a second resilient member. The second disk is coupled to the translation shaft, where the second disk has a second sharpening surface thereon. The second aperture is formed in the first accessory housing, where a portion of the second sharpening surface of the second disk is disposed within the second aperture. A second resilient member is disposed on the first accessory housing proximate the second aperture, where the second resilient member is configured to bias a tool edge against the second sharpening surface of the second disk when the tool edge is disposed within the second aperture. The first sharpening surface and the second sharpening surface can have different sharpening characteristics. In this way, the first disk and the second disk can provide stepwise sharpening functions, for example. The first sharpening surface and the second sharpening surface can include different materials or mediums, can have different coarseness, abrasiveness, or grit values, and/or can provide different angles to the tool edge. A compression spring can be included where the compression spring biases movement of the first disk along a rotation axis of the translation shaft. In this way, as the first resilient member biases the tool edge against the first sharpening surface of the first disk, the compression spring can bias the first disk back against the tool edge. The first resilient member and/or the compression spring can therefore accommodate changes in the tool edge, including changes in geometry of the tool edge and/or forces acting on the tool edge relative to the first resilient member and/or the compression spring.

In certain embodiments, the sharpening accessory is configured as a second sharpening accessory that includes a second accessory housing, a second disk having a second sharpening surface thereon, and a translation shaft disposed within the second accessory housing. The first disk and the second disk are coupled to the translation shaft, where the translation shaft is coupled to the driveshaft to translate rotation of the driveshaft to rotation of the first disk and the second disk when the second sharpening accessory is coupled to the accessory attachment point. A first angled notch is formed in the second accessory housing, where a portion of the first sharpening surface of the first disk disposed within the first angled notch. The first angled notch provides a first bevel angle for a first side of a tool edge disposed therein. A second angled notch is formed in the second accessory housing, where a portion of the second sharpening surface of the second disk is disposed within the second angled notch. The second angled notch provides a second bevel angle for a second side of a tool edge disposed therein.

The second sharpening accessory can include the following aspects. The second sharpening accessory can include where a portion of the second accessory housing between the first angled notch and the second angled notch includes a resilient member having a first resilient portion and a second resilient portion. The first resilient portion is configured to bias the first side of the tool edge against the first sharpening surface of the first disk and the second resilient portion is configured to bias the second side of the tool edge against the second sharpening surface of the second disk. A portion of the second accessory housing between the first angled notch and the second angled notch can also be removable. In this way, the removable portion can be replaced with another removable portion that changes the spacing and/or angle of the first angled notch and/or the second angled notch. Changes in spacing and/or angle can be designed to accommodate different tool edge geometries and/or bevel angles imparted to the tool edge. A compression spring can also be provided where the compression spring biases movement of the first disk and the second disk along a rotation axis of the translation shaft. In this way, a force directing the tool edge against one of the first disk and the second disk can be counteracted by the biasing force of the compression spring.

In certain embodiments, the second sharpening accessory can include the following aspects. A third angled notch can be formed in the second accessory housing, where a portion of the first sharpening surface of the first disk is disposed within the third angled notch and the third angled notch provides a third bevel angle for the first side of a tool edge disposed therein. A fourth angled notch can be formed in the second accessory housing, where a portion of the second sharpening surface of the second disk is disposed within the fourth angled notch and the fourth angled notch provides a fourth bevel angle for a second side of a tool edge disposed therein. A portion of the second accessory housing between the first angled notch and the second angled notch can include a resilient member having a first resilient portion and a second resilient portion. The first resilient portion can be configured to bias the first side of the tool edge against the first sharpening surface of the first disk and the second resilient portion can be configured to bias the second side of the tool edge against the second sharpening surface of the second disk. A portion of the second accessory housing between the third angled notch and the fourth angled notch can be removable.

In certain embodiments, the second sharpening accessory can include the following aspects. A third disk having a third sharpening surface thereon can be provided. A fourth disk having a fourth sharpening surface thereon can also be provided. The third disk and the fourth disk can be coupled to the translation shaft, where the translation shaft is coupled to the driveshaft to translate rotation of the driveshaft to rotation of the third disk and the fourth disk when the second sharpening accessory is coupled to the accessory attachment point. A third angled notch can be formed in the second accessory housing, where a portion of the third sharpening surface of the third disk is disposed within the third angled notch and the third angled notch provides a third bevel angle for a first side of a tool edge disposed therein. A fourth angled notch can be formed in the second accessory housing, where a portion of the fourth sharpening surface of the fourth disk is disposed within the fourth angled notch and the fourth angled notch provides a fourth bevel angle for a second side of a tool edge disposed therein. The first sharpening surface and the second sharpening surface can have different sharpening characteristics from the third sharpening surface and the fourth sharpening surface. In this way, for example, the first and second disks can provide a particular sharpening characteristic to each side of a tool edge and the third and fourth disks can provide another particular sharpening characteristic to each side of the tool edge. This can allow sequential or stepwise sharpening operations, for example.

In certain embodiments, the sharpening accessory is configured as a third sharpening accessory that includes a third accessory housing and a chuck, where the first disk is reversibly coupled to the chuck. A translation shaft is disposed within the third accessory housing, where the translation shaft couples the driveshaft to the chuck to translate rotation of the driveshaft to rotation of the first disk when the third sharpening accessory is coupled to the accessory attachment point. The first sharpening surface of the first disk can be convex.

Also provided are various sharpening tool kits. A sharpening tool kit can include a sharpening tool as described herein along with one or more of a first sharpening accessory as described herein, a second sharpening accessory as described herein, and a third sharpening accessory as described herein. Each sharpening accessory can be configured to be reversibly coupled to the accessory attachment point of the sharpening tool. In certain embodiments, the sharpening tool kit includes the first sharpening accessory, the second sharpening accessory, and the third sharpening accessory. The kit can also include multiple portions of the removable second accessory housing located between the first angled notch and the second angled notch to allow changing the spacing and/or angle of the first angled notch and/or the second angled notch to accommodate different tool edge geometries and/or bevel angles to be imparted to the tool edge.

Certain embodiments of the sharpening tool can be configured with one or more additional functionalities. These include where the sharpening tool is a handheld tool that can be operated with one or two hands. For example, the first handle can be connected to the housing at two points and the second handle can project from the housing from a single point. Each handle can be integrally formed as part of the housing, where the housing itself can be formed of two or more pieces or shells (e.g., clamshell configuration) that are joined by various fasteners, such as screws, bolts, clamps, etc. The electric motor can operate as a variable speed unit where the switch can increase and decrease a rotation speed of the driveshaft and hence the translated rotation to the first disk. The accessory attachment point can be configured as a self-aligning and tool-less coupling for the various sharpening accessories and can be rotated or pivoted to position various sharpening accessories to an optimum working position by rotating or pivoting from various horizontal positions and/or various vertical positions with respect to a remainder of the sharpening tool. For example, the accessory attachment point can be pivoted in a horizontal arc and/or vertical arc from approximately 0-80 degrees. The sharpening accessories can have various disks having various sharpening surfaces configured for various tool edges. The disks can be replaceable in some embodiments to allow the sharpening accessory to refurbished and/or configured with a different disk having different sharpening characteristics; e.g., different abrasive media, different angle or surface shape including different convex curvatures, different coarseness, abrasiveness, or grit values.

Embodiments include where the sharpening accessory can be removed and replaced from the remainder of the sharpening tool with a simple catch and release button/lever. The angle of approach to a work surface can be adjusted with multiple rotating and angular pivoting and locking positions between the accessory attachment point and the housing of the sharpening tool. For example, the driveshaft can include a universal joint between the electric motor and a coupling point for the sharpening accessory to translate rotation of the driveshaft to rotation of the first disk of the sharpening accessory. For knife and scissor sharpening accessories, for example, the accessory can be positioned direct in line with the centerline of an operator's left hand. When grinding and sharpening a lawn mower blade or other tool edge secured in a bench vise, for example, angular adjustment of the accessory attachment point can allow an operator to hold the first handle (and nearby switch) in the right hand and hold the second handle in the left hand (or vice versa) and approach the secured lawn mower blade or other tool edge at a 10-90 degree angle from a vertical and upright standing operator.

The electric motor of the sharpening tool can be configured in various ways. For example, the electric motor can be an enclosed in its own a motor housing. The motor housing enclosing the electric motor can function as an electric motor module for ease of assembly and/or repair/replacement of the electric motor module. The electric motor can be insulated and vibration isolated to protect the electric motor and the operator from shock or undue vibration transmission to operator's extremities. The motor can be selectively actuated by either a DC power cord or an AC/DC converter power cord and a variable speed power tool-like switch. The switch can be configured as a trigger allowing operation using one or more fingers. The electric motor can be started using pulsing technology that limits current and will not overload the AC/DC converter. The electric motor can have grounded UL certified cordage. The electric power input can include 120 volt, 230 volt, and some form of battery charged 9.6-30 volt DC power unit. The sharpening tool and or sharpening tool kit can include a battery charger.

Further aspects of the sharpening tool include the following features. The various handles and switch can be ergonomically designed to optimize gripping and maneuvering of the sharpening tool by the operator. Light weight materials, such as a plastic, and an impact resistant housing can be employed to reduce operator fatigue and optimize durability. For example, the housing can be formed of glass filled Nylon 66 or like material. Coupling of the driveshaft to translate rotation of the driveshaft to rotation of a first disk (e.g., by coupling to the translation shaft) can be standardized using a universal drive configuration (e.g., ¼" hex). The sharpening accessory, when coupled to the remainder of the sharpening tool, can provide a substantially continuous and flat bottom surface for optimized stability when operating the sharpening tool as it rests, sits upon, or is pressed down against a surface such as a floor or bench top. The various handles can have over-molded rubber gripping surfaces. The sharpening tool can provide a light weight and portable unit that can be brought to the location of the tool to be sharpened.

Examples

Example embodiments of the present technology are provided with reference to the several figures enclosed herewith.

Figure 2:
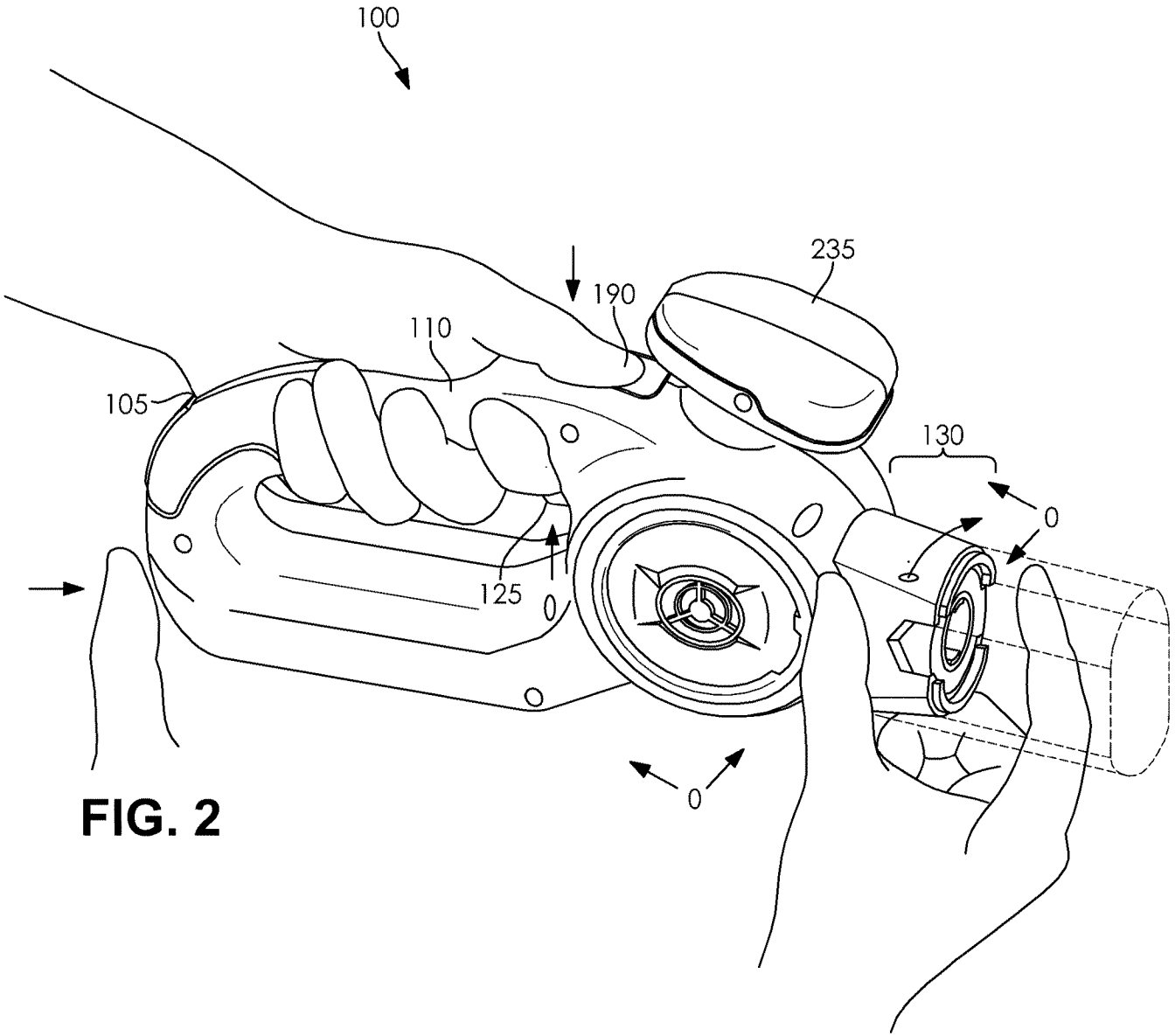
Figure 3:
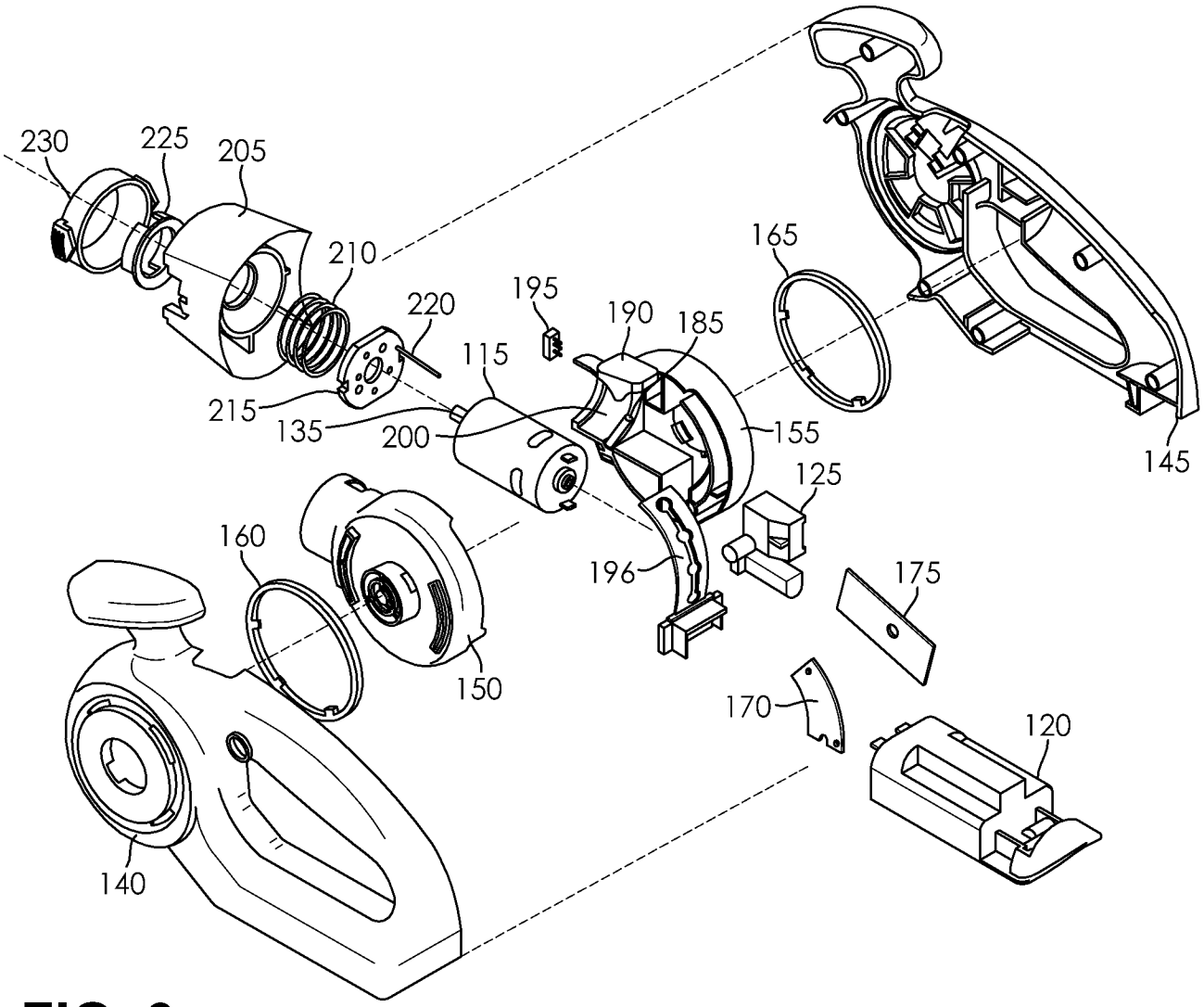
FIG. 3 is an exploded view of the embodiment of the sharpening tool without a sharpening accessory coupled to an accessory attachment point, as per FIG. 1.

With reference to FIGS. 1-3, an embodiment of a sharpening tool without a sharpening accessory coupled to an accessory attachment point is shown.

The sharpening tool 100 includes a housing 105, a first handle 110, an electric motor 115, an electric power input 120, a switch 125, and an accessory attachment point 130. The first handle 110 is disposed on the housing 105. The electric motor 115 is disposed within the housing 105, where the electric motor 115 is configured to rotate a driveshaft 135. The switch 125 is disposed on the housing 105, where the switch 125 is selectable to operate the electric motor 115 using the electric power input 120. The accessory attachment point 130 is on the housing 105.

As shown, the housing 105 is configured as a first clamshell half 140 and a second clamshell half 145. Assembly of the housing 105 includes cooperative housing subcomponents 150, 155, fasteners 160, 165, plates 170, 175, and pins 180, 185, which can arrange and secure portions of the sharpening tool 100, including portions connected to and internal to the housing 105. A safety switch 190 is included on the housing 105, where actuation of the safety switch 190 trips an internal switch 195 that allows an operator of the sharpening tool 100 to actuate the switch 125 to operate the electric motor 115 using the electric power input 120. A spring 200 can maintain the safety switch 190 in a safe or off position, where actuation of the safety switch 190 requires applying a compressive force to the spring 200. Otherwise, manipulation of the switch 125 by the operator will not engage the electric motor 115. Although not shown, other fasteners and housing 105 skeletal structures can be used to secure components of the sharpening tool 100 together.

Figure 8:
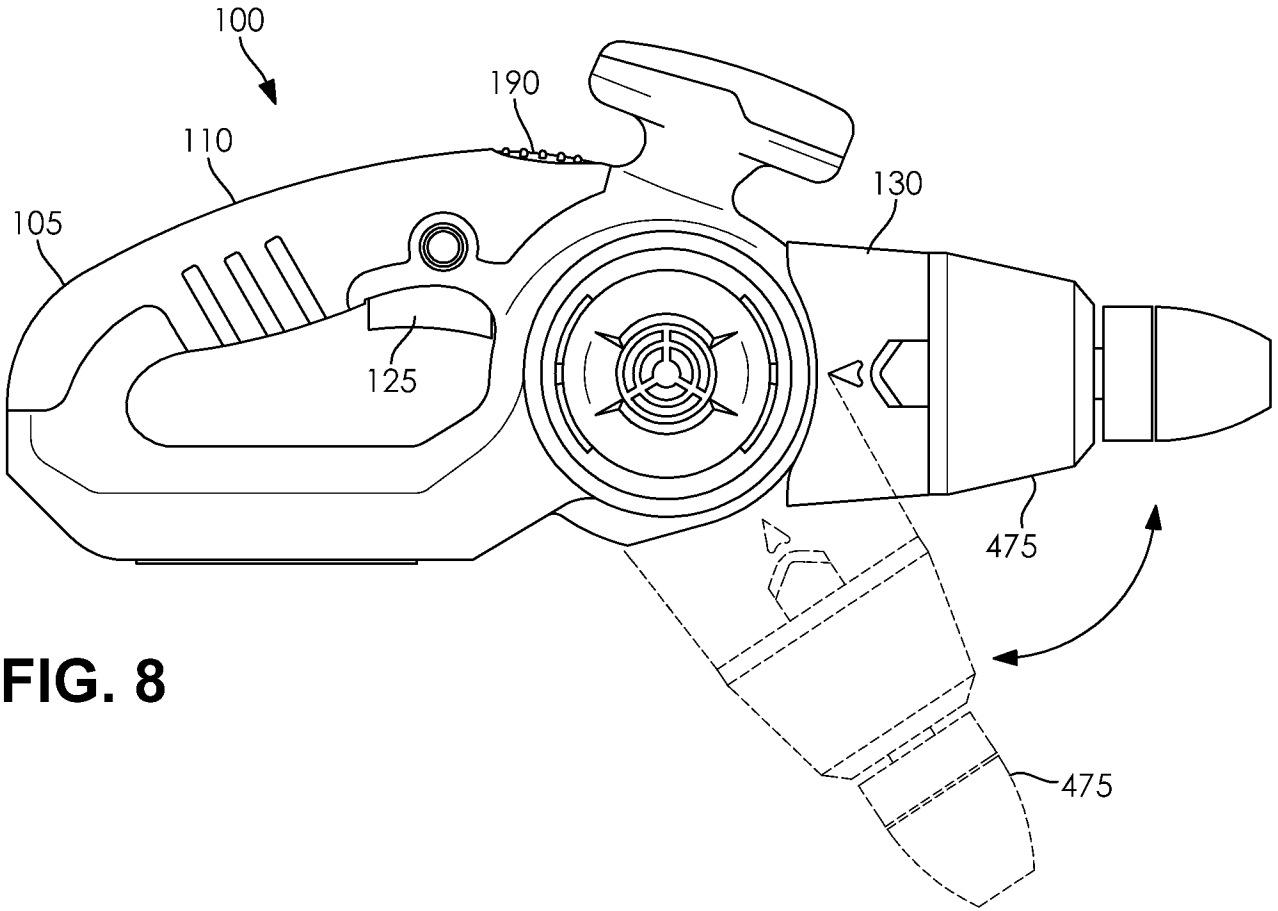
FIG. 8 is a side elevational view of the embodiment of the sharpening tool, as per FIG. 1, with a third sharpening accessory coupled to the accessory attachment point.

In some embodiments, the safety switch 190 is further configured or alternatively configured to permit pivoting or rotation of a sharpening accessory (e.g., see first sharpening accessory 240, second sharpening accessory 340, or third sharpening accessory 475, as further described herein) that is coupled to the accessory attachment point 130, the pivoting or rotation occurring with respect to a remainder of the sharpening tool 100 (e.g., FIG. 8, which shows two possible positions of the third sharpening accessory 475). Actuation of the safety switch 190 in this manner allows the sharpening accessory to continuously pivot throughout an predefined arc or to pivot and lock at predefined stops up to a maximum pivot angle; e.g., between 0-90 degrees. For example, pivoting can be facilitated by pivoting along a slot provided in pivot guide 196, where the holes in the pivot guide 196 can establish predefined stops or pivot points. The pivoting function can therefore allow an operator to optimize the approach of the sharpening tool 100 with respect to the operator's position relative to the intended work surface or tool edge to be sharpened.

The accessory attachment point 130 allows reversible coupling of various sharpening accessories. As shown, the accessory attachment point 130 is configured to provide a twist-locking action for coupling of a sharpening accessory without the use of a tool or key. Other couplings can be used, such as various locking actions, including snap-fitting actions, detent locking actions, as well as threaded couplings, spring-clips, and retaining pins. The accessory attachment point 130 includes an accessory attachment point housing 205 that partially encloses a compression spring 210 abutting plate 215, where the plate is coupled to a remainder of the sharpening tool 100 using pin 220. It should be noted that the accessory attachment point housing 205 can also represent part of an accessory housing that is associated with and removable with the sharpening accessory. A coupling support 225 is held by a locking collar 230, where the locking collar 230 can be twisted or rotated to engage and lock a sharpening accessory to the accessory attachment point 130. As with the accessory attachment point housing 205, the coupling support 225 and locking collar 230 can be associated with the sharpening accessory, configured as part of the sharpening accessory, and removable with the sharpening accessory. In certain embodiments, the accessory attachment point 130 can therefore simply include a portion of the housing 105, where the accessory attachment point housing 205, the coupling support 225, and locking collar 230 are all configured as part of the sharpening accessory and are removable with the sharpening accessory. In this manner, the sharpening accessory can be reversibly coupled to the accessory attachment point 130, where the sharpening accessory is thereby coupled the driveshaft 135 to translate rotation of the driveshaft 135 to rotation of a first disk having a first sharpening surface thereon when the sharpening accessory.

As shown in the embodiment provided in the figures, the first handle 110 is formed as an integral portion of the housing 105. A second handle 235 projects from a single point of the housing 105. The switch 125 is a variable speed switch configured to operate the electric motor 115 at a plurality of speeds and rotate the driveshaft 135 at a plurality of speeds. The electric power input 120 is configured as a replaceable and rechargeable battery. For example, the battery can be configured for charging within the sharpening tool 100 or the battery can be removed from the sharpening tool 100 and placed in a separate charger. Although not shown, it is understood that the electric power input can include an electric cord configured to electrically couple the sharpening tool to an electric power system; e.g., a three-prong grounded electric cord.

Figure 4:
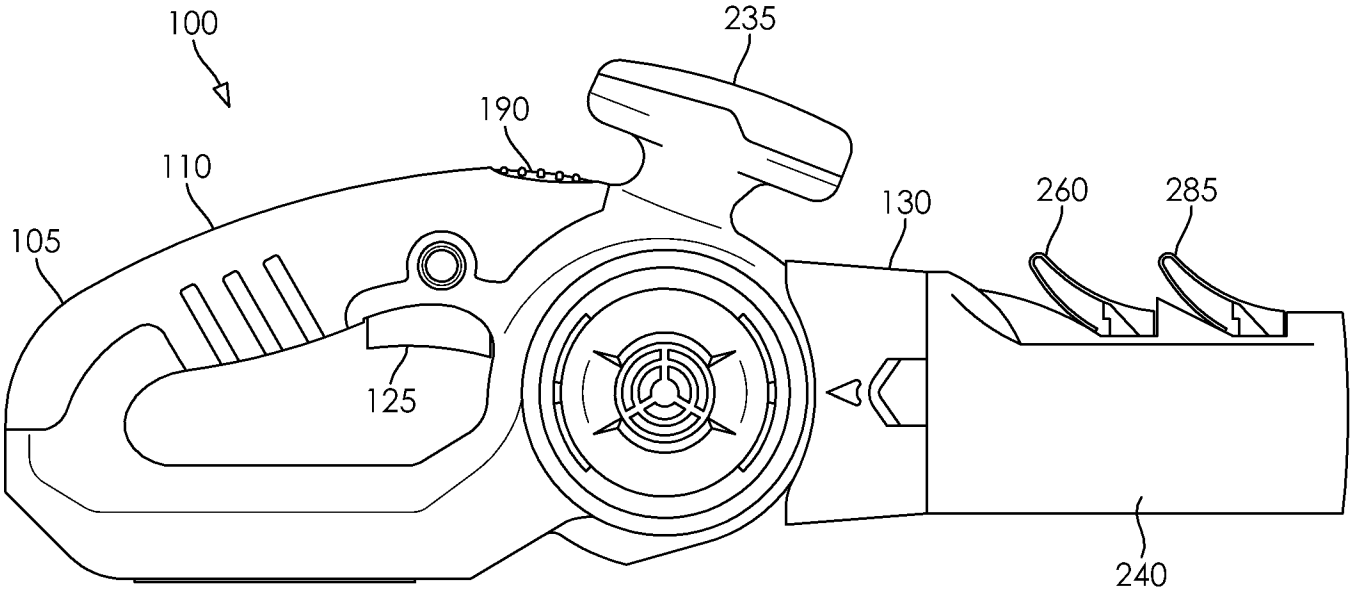
FIG. 4 is a side elevational view of the embodiment of the sharpening tool, as per FIG. 1, with a first sharpening accessory coupled to the accessory attachment point that can be used for sharpening scissors.
Figure 5:
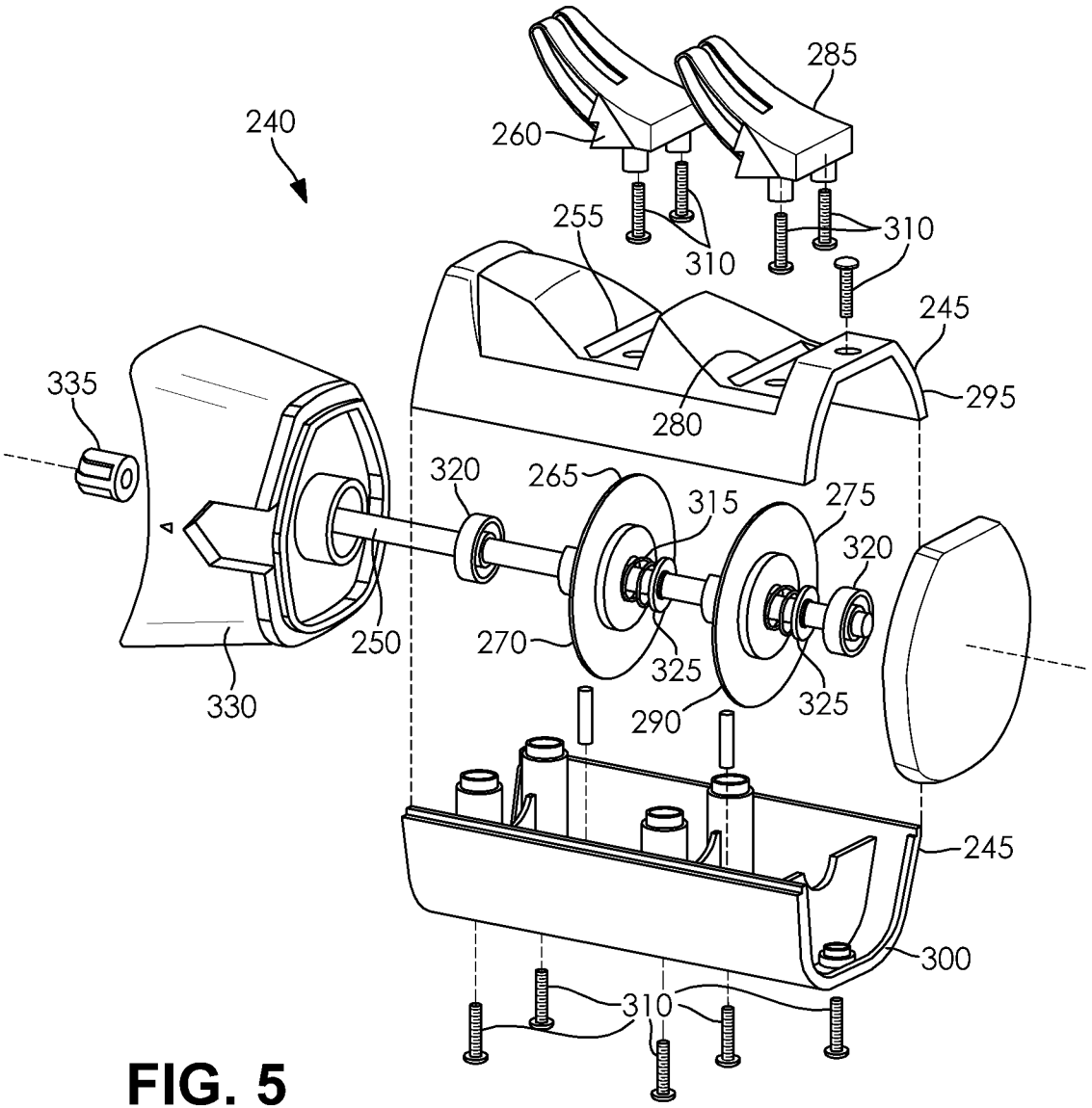
FIG. 5 is an exploded view of the first sharpening accessory of FIG. 4.

With reference to FIGS. 4-5, an embodiment of the sharpening tool 100 with a first sharpening accessory 240 coupled to the accessory attachment point 130 is shown, where the first sharpening accessory can be used to sharpen scissors. The first sharpening accessory includes a first accessory housing 245, a first translation shaft 250, a first aperture 255, and a first resilient member 260. The first translation shaft 250 is disposed within the first accessory housing 245, a first disk 265 is coupled to the first translation shaft 250, the first translation shaft 250 is coupled to the driveshaft 135 to translate rotation of the driveshaft 135 to rotation of the first disk 265 when the first sharpening accessory 240 is coupled to the accessory attachment point 130. The first aperture 155 is formed in the first accessory housing 245 where a portion of a first sharpening surface 270 of the first disk 265 is disposed within the first aperture 255. The first resilient member 260 is disposed on the first accessory housing 245 proximate the first aperture 255, where the first resilient member 260 is configured to bias a tool edge against the first sharpening surface 270 of the first disk 265 when the tool edge is disposed within the first aperture 255.

In the embodiment shown, the first sharpening accessory 240 includes a second disk 275, a second aperture 280, and a second resilient member 285. The second disk 275 is coupled to the first translation shaft 250, where the second disk 275 has a second sharpening surface 290 thereon. The second aperture 280 is formed in the first accessory housing 245, where a portion of the second sharpening surface 290 of the second disk 275 is disposed within the second aperture 280. The second resilient member 285 is disposed on the first accessory housing 245 proximate the second aperture 280, where the second resilient member 285 is configured to bias a tool edge against the second sharpening surface 290 of the second disk 275 when the tool edge is disposed within the second aperture 280.

As shown, the first accessory housing 245 is formed as a first clamshell half 295 and a second clamshell half 300. The first and second clamshell halves 295, 300, an end plate 310, and the first and second resilient members 260, 285 are joined together with fasteners 310. The first sharpening surface 270 of the first disk 265 and the second sharpening surface 290 of the second disk 275 have different sharpening characteristics; e.g., different abrasive media, different angle or surface shape including different convex curvatures, different coarseness, abrasiveness, or grit values. A compression spring 315 biases movement of the first disk 265 along a rotation axis A of the first translation shaft 250, where the compression spring 315 works in conjunction with washers 325 on the first translation shaft 250. Bearings 320 isolate rotation of the first translation shaft 250 with respect to the housing 245 of the first sharpening accessory 240. The first sharpening accessory 240 can also include a housing coupling portion 330 that can function as the accessory attachment point housing 205. A spline end 335 can be attached or formed at the end of the first translation shaft 250 where a male-female spline arrangement can be used to couple the first translation shaft 250 to the driveshaft 135 of the electric motor 115 to translate rotation of the driveshaft 135 to rotation of the first disk 265 (and the second disk 275) when the first sharpening accessory 240 is coupled to the accessory attachment point 130.

Figure 6:
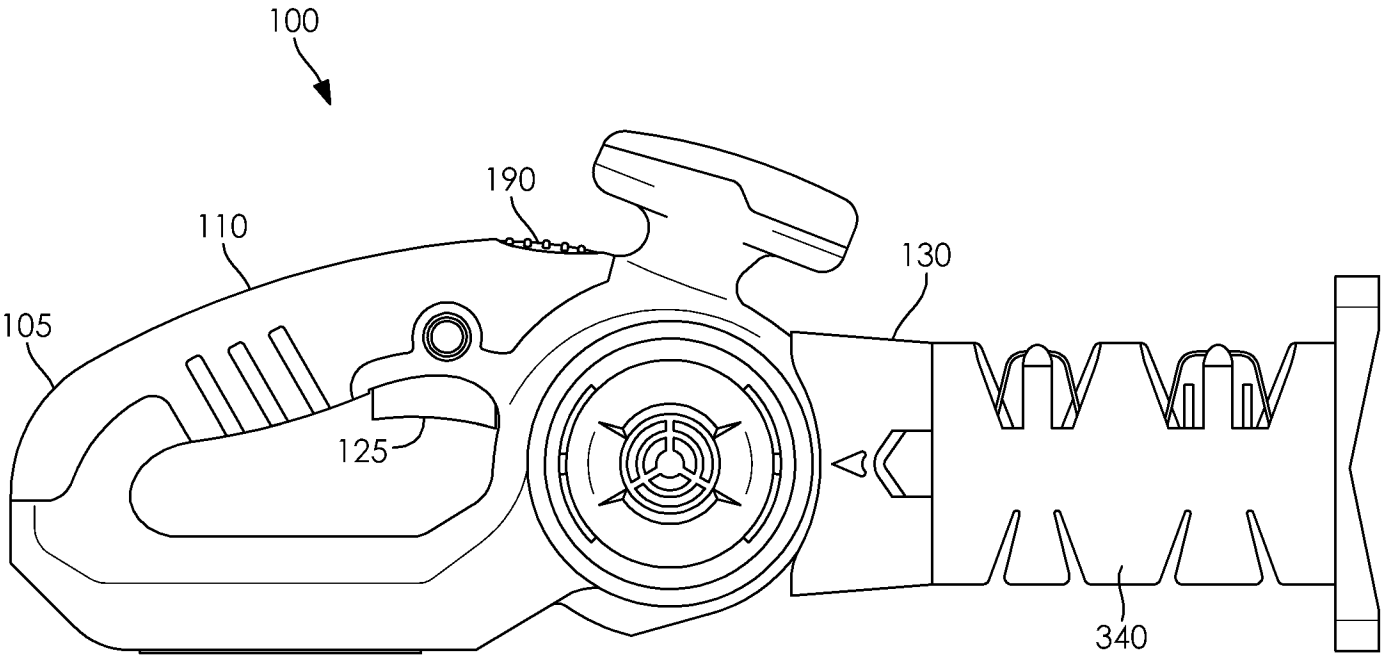
FIG. 6 is a side elevational view of the embodiment of the sharpening tool, as per FIG. 1, with a second sharpening accessory coupled to the accessory attachment point that can be used to sharpen thin knives in the bottom angled notches and thick knives in the top angled notches.
Figure 7:
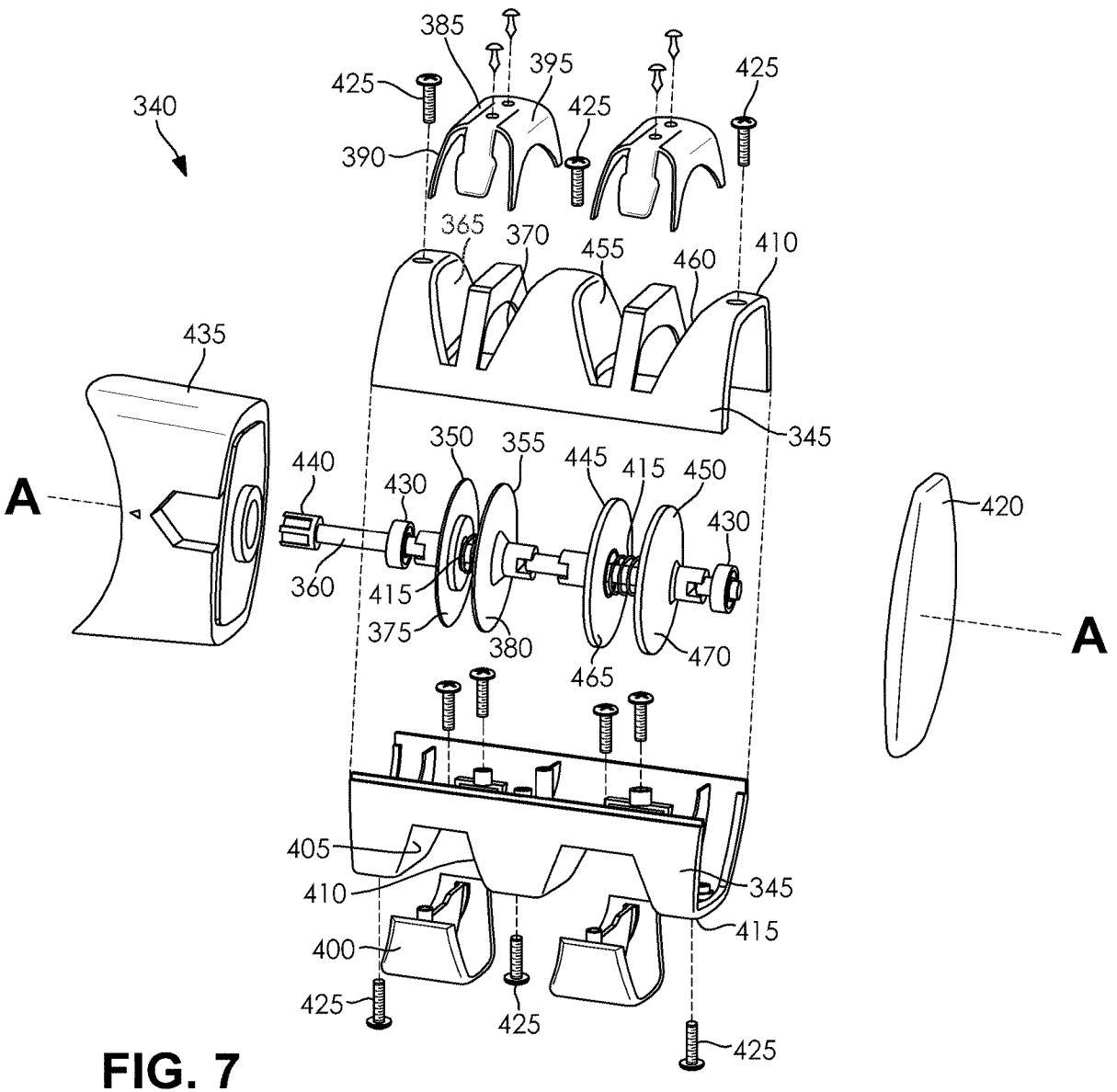
FIG. 7 is an exploded view of the second sharpening accessory of FIG. 6.

With reference to FIGS. 6-7, an embodiment of the sharpening tool 100 with a second sharpening accessory 340 coupled to the accessory attachment point 130 is shown. The second sharpening accessory 340 includes a second accessory housing 345, a first disk 350, a second disk 355, a second translation shaft 360, a first angled notch 365, and a second angled notch 370. The first disk 350 has a first sharpening surface 375 thereon and the second disk 355 has a second sharpening surface 380 thereon. The second translation shaft 360 is disposed within the second accessory housing 345, the first disk 350 and the second disk 355 are coupled to the second translation shaft 360, and the second translation shaft 360 is coupled to the driveshaft 135 of the electric motor 115 to translate rotation of the driveshaft 135 to rotation of the first disk 350 and the second disk 355 when the second sharpening accessory 340 is coupled to the accessory attachment point 130. The first angled notch 365 is formed in the second accessory housing 345, where a portion of the first sharpening surface 375 of the first disk 350 is disposed within the first angled notch 365. The first angled notch 365 thereby provides a first bevel angle for a first side of a tool edge disposed therein. The second angled notch 370 is formed in the second accessory housing 345, where a portion of the second sharpening surface 380 of the second disk 355 is disposed within the second angled notch 370. The second angled notch 370 thereby provides a second bevel angle for a second side of a tool edge disposed therein.

In the embodiment shown, a portion of the second accessory housing 345 between the first angled notch 365 and the second angled notch 370 includes a resilient member 385 having a first resilient portion 390 and a second resilient portion 395. The first resilient portion 390 is configured to bias the first side of the tool edge against the first sharpening surface 375 of the first disk 350 and the second resilient portion 395 is configured to bias the second side of the tool edge against the second sharpening surface 380 of the second disk 355. A portion of the second accessory housing 345 between the first angled notch 365 and the second angled notch 370 can be removable; however, as shown in the embodiment depicted, a portion 400 of the second accessory housing 345 between an alternate first angled notch 405 and an alternate second angled notch 410 is removable. In this way, geometries of the first angled notch 365 and the second angled notch 370 can be optimized to accommodate the sharpening of wide or narrow knives. A compression spring 415 biases movement of the first disk 350 and the second disk 355 along a rotation axis A of the second translation shaft 360. The second accessory housing 345 is formed as a first clamshell half 410 and a second clamshell half 415. The first and second clamshell halves 410, 415, and an end plate 420 are joined together with fasteners 425.

Bearings 430 isolate rotation of the second translation shaft 360 with respect to the second accessory housing 345 of the second sharpening accessory 340. The second sharpening accessory 340 can also include a housing coupling portion 435 that can function as the accessory attachment point housing 205. A spline end 440 can be attached or formed at the end of the second translation shaft 360 where a male-female spline arrangement can be used to couple the second translation shaft 360 to the driveshaft 135 of the electric motor 115 to translate rotation of the driveshaft 135 to rotation of the first disk 350 (and the second disk 355) when the second sharpening accessory 340 is coupled to the accessory attachment point 130.

As shown, the second sharpening accessory 340 includes a third disk 445, a fourth disk 450, a third angled notch 455, and a fourth angled notch 460. The third disk 445 has a third sharpening surface 465 thereon and the fourth disk 450 has a fourth sharpening surface 470 thereon. The third disk 445 and the fourth disk 450 are coupled to the second translation shaft 360, where the second translation shaft 360 is coupled to the driveshaft 135 of the electric motor 115 to translate rotation of the driveshaft 135 to rotation of the third disk 445 and the fourth disk 450 when the second sharpening accessory 340 is coupled to the accessory attachment point 130. The third angled notch 455 is formed in the second accessory housing 345, where a portion of the third sharpening surface 465 of the third disk 445 is disposed within the third angled notch 455. The third angled notch 455 provides a third bevel angle for a first side of a tool edge disposed therein. The fourth angled notch 460 is formed in the second accessory housing 345, where a portion of the fourth sharpening surface 470 of the fourth disk 450 is disposed within the fourth angled notch 460. The fourth angled notch 460 provides a fourth bevel angle for a second side of a tool edge disposed therein. In the embodiment depicted, the first sharpening surface 375 of the first disk 350 and the second sharpening surface 380 of the second disk 355 have different sharpening characteristics from the third sharpening surface 465 of the third disk 445 and the fourth sharpening surface 470 of the fourth disk 450, where different sharpening characteristics include different abrasive media, different angle or surface shapes including different convex curvatures, and/or different coarseness, abrasiveness, or grit values.

Figure 9:
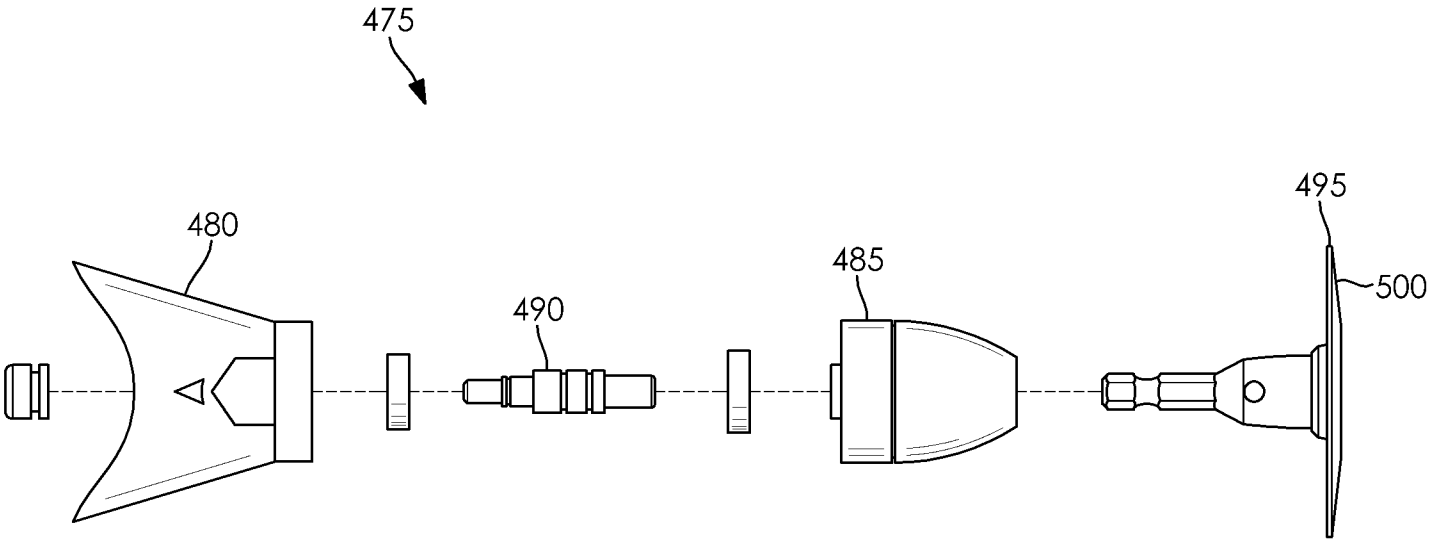
FIG. 9 is an exploded view of the third sharpening accessory of FIG. 8 and a disk having a sharpening surface thereon.

With reference to FIGS. 8-9, an embodiment of the sharpening tool 100 with a third sharpening accessory 475 coupled to the accessory attachment point 130 is shown. The third sharpening accessory 475 includes a third accessory housing 480, a chuck 485, a third translation shaft 490, and a first disk 495. The first disk 495 is reversibly coupled to the chuck 485, where it is understood that the chuck 485 allows interchange of different types of first disks 495, including various first disks 495 having different abrasive media, different angle or surface shapes including different convex curvatures, different coarseness, abrasiveness, or grit values, etc. The third translation shaft 490 is disposed within the third accessory housing 480, where the third translation shaft 490 couples the driveshaft 135 from the electric motor 115 to the chuck 485 to translate rotation of the driveshaft 135 to rotation of the first disk 495 when the third sharpening accessory 475 is coupled to the accessory attachment point 130. The first disk 495 has a convex first sharpening surface 500.

As shown in FIG. 8, the third sharpening accessory 475 of the sharpening tool 100 can also pivot throughout an angle to change the orientation of the third sharpening accessory 475 with respect the remainder of the sharpening tool 100. The angle can be changed to optimize orientation of the first disk 495 with respect to the shape and/or location of the tool edge to be sharpened and a position of the sharpening tool operator. Although not shown, the first sharpening accessory 240 (FIGS. 4-5) and the second sharpening accessory 340

(FIG. 6-7) can also be configured to pivot relative to the remainder of the sharpening tool 100 in a similar fashion. In certain embodiments, the safety switch 190 can have a separate actuation motion or function that is required to pivot the respective sharpening accessory; e.g., 240, 340, 475. A separate switch (not shown) can also be included on the sharpening tool 100 to release and lock the pivoting action of the sharpening accessory, which can be configured to continuously pivot throughout a defined arc (e.g., 0-90 degrees) or can be configured to pivot and stop at a defined number of predetermined angles (e.g., 15, 30, 45, 60, 75, 90 degrees or subsets thereof).

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods can be made within the scope of the present technology, with substantially similar results.

What is claimed is:

1. A sharpening tool comprising:

a housing;

a first handle disposed on the housing;

an electric motor disposed within the housing, the electric motor configured to rotate a driveshaft about a driveshaft axis of rotation extending in an axial direction of the driveshaft;

an electric power input;

a switch disposed on the housing, the switch selectable to operate the electric motor using the electric power input;

an accessory attachment structure coupled to the electric motor and the driveshaft, wherein the electric motor, the driveshaft, and the accessory attachment structure are configured to rotate in unison relative to the housing about an accessory axis of rotation, wherein the accessory axis of rotation is arranged perpendicular to the driveshaft axis of rotation; and a sharpening accessory configured to be removably coupled to the accessory attachment structure, the sharpening accessory coupled to the driveshaft to translate rotation of the driveshaft about the driveshaft axis of rotation to rotation of a first disk having a first sharpening surface thereon when the sharpening accessory is coupled to the accessory attachment structure.

2. The sharpening tool of claim 1, wherein the first handle is formed as an integral portion of the housing.

3. The sharpening tool of claim 1, further comprising a second handle projecting from a single point of the housing.

4. The sharpening tool of claim 1, wherein the switch is a variable speed switch configured to operate the electric motor at a plurality of speeds and rotate the driveshaft about the driveshaft axis of rotation at a plurality of speeds.

5. The sharpening tool of claim 1, wherein the electric power input includes an electric cord configured to electrically couple the sharpening tool to an electric power system.

6. The sharpening tool of claim 1, wherein the electric power input includes a rechargeable battery.

7. The sharpening tool of claim 1, wherein the sharpening accessory is a first sharpening accessory including:

a first accessory housing;

a first translation shaft disposed within the first accessory housing, the first disk coupled to the first translation shaft, the first translation shaft coupled to the driveshaft to translate rotation of the driveshaft about the driveshaft axis of rotation to rotation of the first disk when the first sharpening accessory is coupled to the accessory attachment structure;

a first aperture formed in the first accessory housing, a portion of the first sharpening surface of the first disk disposed within the first aperture; and a first resilient member disposed on the first accessory housing proximate the first aperture, the first resilient member configured to bias a tool edge against the first sharpening surface of the first disk when the tool edge is disposed within the first aperture.

8. The sharpening tool of claim 7, further comprising:

a second disk coupled to the first translation shaft, the second disk having a second sharpening surface thereon;

a second aperture formed in the first accessory housing, a portion of the second sharpening surface of the second disk disposed within the second aperture; and a second resilient member disposed on the first accessory housing proximate the second aperture, the second resilient member configured to bias a tool edge against the second sharpening surface of the second disk when the tool edge is disposed within the second aperture.

9. The sharpening tool of claim 8, wherein the first sharpening surface and the second sharpening surface have different sharpening characteristics.

10. The sharpening tool of claim 7, further comprising a compression spring biasing movement of the first disk along a rotation axis of the first translation shaft.

11. The sharpening tool of claim 1, wherein, when the sharpening accessory is removably coupled to the accessory attachment structure, the sharpening accessory is configured to rotate relative to the housing about the accessory axis of rotation in unison with the electric motor, the driveshaft, and the accessory attachment structure.

12. The sharpening tool of claim 1, wherein rotation of the electric motor, the driveshaft, and the accessory attachment structure about the accessory axis of rotation results in a reorientation of the driveshaft axis of rotation relative to the housing.

13. The sharpening tool of claim 1, wherein the first handle is connected to the housing at a first point and a second point, wherein the first handle extends away from the housing in a first direction at the first point and wherein the first handle extends away from the housing in a second direction at the second point, wherein the first direction and the second direction are arranged perpendicular to the accessory axis of rotation, and wherein the first direction is angularly offset from the second direction relative to the accessory axis of rotation.

14. The sharpening tool of claim 13, further comprising a second handle connected to the housing at a third point, wherein the second handle extends away from the housing in a third direction at the third point, wherein the third direction is arranged perpendicular to the accessory axis of rotation, and wherein the third direction is angularly offset from the first direction and the second direction relative to the accessory axis of rotation.

15. The sharpening tool of claim 1, further comprising a second handle connected to the housing at a single point, wherein the second handle extends away from the housing at the single point in a direction arranged perpendicular to the accessory axis of rotation.

16. The sharpening tool of claim 1, wherein the electric motor, the driveshaft, and the accessory attachment structure are disposed along the driveshaft axis of rotation.

17. The sharpening tool of claim 16, wherein the sharpening accessory is disposed along the driveshaft axis of rotation when the sharpening accessory is removably coupled to the accessory attachment structure.

18. The sharpening tool of claim 1, wherein the accessory attachment structure is disposed adjacent an end of the driveshaft, wherein the end of the driveshaft extends outside of the housing, and wherein the accessory attachment structure is disposed outside of the housing.

19. The sharpening tool of claim 1, wherein the accessory attachment structure is disposed radially outwardly from the accessory axis of rotation to cause the accessory attachment structure to orbit relative to the accessory axis of rotation when the electric motor, the driveshaft, and the accessory attachment structure rotate relative to the housing about the accessory axis of rotation.

* * * * *